United States Patent [19]

Goodrich

[11] 4,111,180

[45] Sep. 5, 1978

[54] ROCK HOLDING DEVICE

[76] Inventor: Edward Verle Goodrich, 4735 W. 35th Ave., Denver, Colo. 80212

[21] Appl. No.: 836,083

[22] Filed: Sep. 23, 1977

[51] Int. Cl.[2] ..... B25B 5/14

[52] U.S. Cl. ..... 125/35; 269/105; 269/246

[58] Field of Search ..... 269/41, 105, 246; 125/35

[56] References Cited

U.S. PATENT DOCUMENTS 3,682,467 8/1972 Heinrich ..... 269/41

*Primary Examiner*—Robert C. Watson

*Attorney, Agent, or Firm*—Richard D. Law

[57] ABSTRACT

A rock holding device, which can be mounted in a rock-saw vise in such a way that rocks gripped by this device are held firm and secure so they can be sliced by a lapidary (diamond-blade) saw. The device comprises a plate having slidably mounted thereon a finger with a first bevelled surface and bars fixedly mounted on the plate and having second and third bevelled surfaces facing the first bevelled surface.

8 Claims, 3 Drawing Figures

ROCK HOLDING DEVICE

SUMMARY OF THE INVENTION

The present invention relates to a novel clamping device which in turn can be clamped into the diamond-saw vise itself so that the rock held by the device is held securely and positively so it will neither turn, nor fall out during the rock-slicing process. This positive and secure clamping is ensured by the three-fingered gripping action of the device.

Two bevelled bars are fixed on a mounting plate, and the third movable finger is so constructed that it can be positioned by a locking device to take larger or smaller rocks, and then can be securely clamped against the rock by screw action, air-pressure action, or by hydraulic pressure action, or by any other means which provides a means of applying direct pressure, constantly applied, on this moving finger against the rock to be held. Also, the two fixed bars, as well as the movable finger, may be supplied with faces having different bevels. The bevel can be varied so it will grip the rock in the most secure manner possible for that hardness or shape of rock.

As a requisite of the use of this device, is the fact that the rock to be sliced or cut must first have a smooth, plane side, or else the rock must first be cut in two with the diamond saw, providing a smooth, plane surface which can be clamped down on the plane base of the rock holding device.

An advantage of this device is the fact that after the user has cut the rock in two to determine what the interior is like, he may clamp either portion in the holder and parallel slices can be cut from the parent rock until there is only one slice left, which is the piece being gripped by the rock holder itself. This makes it possible to utilize all of the rock in the cutting process.

DESCRIPTION OF THE PREFERRED EMBODIMENT

Figure 3:
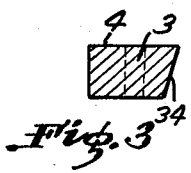
FIG. 3 is a cross sectional view of a bevelled bar of FIG. 1, taken along line A—A.

The patent drawing shows in plan and elevation the two fixed bevelled bars 2, 4 against which a rock to be cut to be forced. Also, the movable finger (5), with a bevelled tip is shown both in plan and in elevation. This finger can be positioned by loosening and then tightening nut 16 on bolt 17, as will be described below. The bars extend from a mounting plate, comprising a planar working surface 18 and an underside 19. Nut 16 abuts the underside of the mounting plate 1. Bolt 17 extends through a slot 9 disposed along the longitudinal axis of the mounting plate 1. The bolt 17 is welded into an angle bracket 11. The angle bracket 11 comprises a planar base portion 20, which receives bolt 17, and an upright portion 22 extending perpendicularly outwardly from the base portion. Upright portion 22 has disposed therein a threaded opening 24 through which a clamping screw 10 is threaded. The clamping screw 10 is thereby threadably adjustable along the longitudinal axis in a line parallel to the working of plate 1. As used generally in the present specification, forward refers to the longitudinal direction facing the bevelled bars 2, 4. The forward end of clamping screw 10 is pointed. The pointed end of clamping screw 10 abuts a corresponding conical depression 26 in the rearward surface of an upright portion 8 in the rear portion of finger 5. Pin 7 is pressed into finger 5 and is free to slide in slot 9 and acts to keep this working finger assembly comprising finger 5, angle bracket 11, and clamping screw 10, in correct alignment as it moves against the rock to be held. Bolt 6 is the final holding bolt, which, when tightened, firmly holds the finger assembly securely against the rock which is to be cut. Bolt 6 is threaded into the underside of finger 5 in a portion of the finger forward of the guide pin 7. The shaft of bolt 6 extends through slot 9 and is narrower than the slot. The head of bolt 6 is wider than the slot and abuts the underside of mounting plate 1. Various spacers of different thickness may be placed under the rock and on top of plate 1 to make it possible to cut the last slice nearer the bottom face of the rock. The slot 19 lies along the longitudinal axis of mounting plate 1. For greatest adjustment, the slot 9 may extend along a substantial portion, or nearly the entire length, of the mounting plate. The underside 28 of finger 5 is planar and provides a broad area of contact with the working surface 18 of the mounting plate 1.

Figure 2:
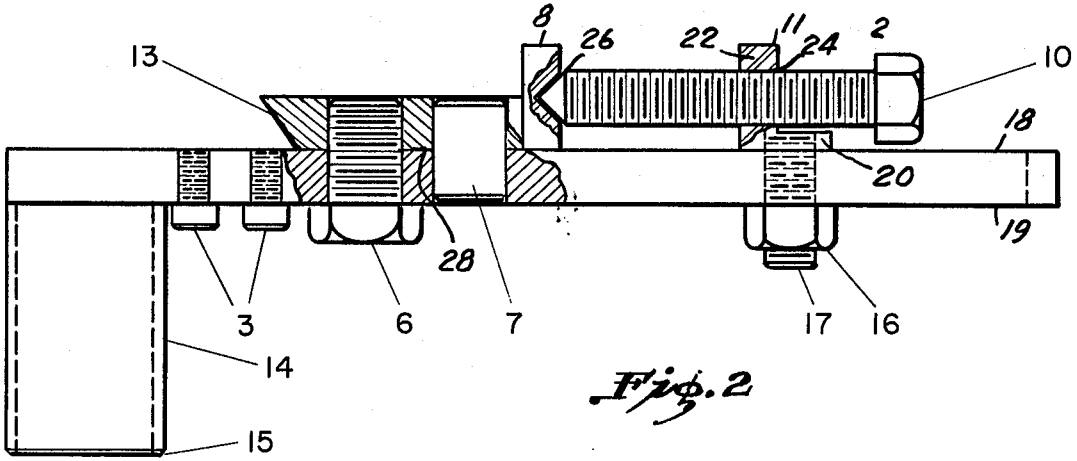
FIG. 2 is a side view of the device of FIG. 1, in partial section, and with the bevelled bars removed for clarity.

The forward end of finger 5 is bevelled to provide a wedge-shaped finger which holds the rock against a true flat surface 18 when the clamp screw is tightened. Thus, the forwardmost surface 13 of finger 5 lies in a plane transverse to the longitudinal slot 9 and extending forwardly upwardly from the working surface 18 of the mounting plate 1 at an acute angle, as is shown in FIG. 2. The planar surface 13 does not extend along the entire width of finger 5 due to shoulder portions 30, 32 extending rearwardly therefrom.

Figure 1:
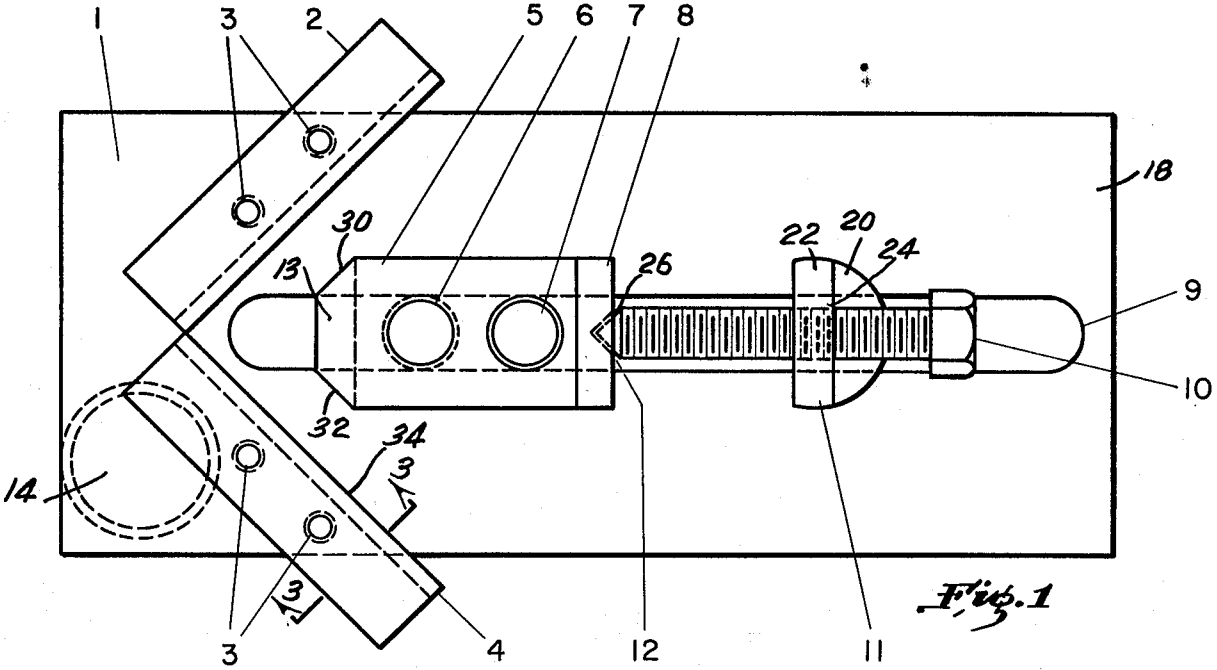
FIG. 1 is a plan view of the rock holding device of the present invention.

The bevelled bars 2, 4 are fixedly mounted on the working surface 18 of mounting plate 1 through a plurality of mounting screws 3. The bars are mounted in an approximate right angle with respect to each other, with their innermost corners in contact with each other and facing the mounting finger 5. The right angle formed between the mounting bars lies such that it is approximately bisected by slot 9. The length of the bevelled face 13 of the finger 5 is transversely approximately perpendicular to slot 9 and is of the same approximate length as the width of slot 9, as shown in FIG. 1. A longitudinal line along face 13 would therefore intersect bar 2 and bar 4 at points approximately equidistant from the vertex of the angle between the bars. The surfaces of bars 2, 4 facing the finger 5 are also bevelled to make these bars wedge-shaped so as to hold the rock to be cut against the flat working surface 18 of mounting plate 1. As shown in FIG. 3, the surface 34 of bar 4 is bevelled upwardly towards the finger 5 at approximately a 70° angle.

The movable finger (5) and the whole moveable assembly are so arranged that they can be positioned by loosening and tightening nut 16 on bolt 17, so the assembly can take a larger or smaller rock. Pin 7 is pressed into finger 5 and is of such a diameter that only a few-thousandths of an inch clearance are presented in slot 9 and the pin slides easily in slot 9 without undue play or slack. Thus, pin 7 acts as a guide to keep plate 5 in correct alignment as finger 5 is pressed forward upon the rock to be held. When the rock is ready to be placed in the holder, bolt 6 should be tightened just enough to allow finger 5 to advance against the rock without undue play or slack. Then nut 16 is loosened enough to allow the movable finger assembly to slide back in slot 9 until there is clearance for the rock to be installed. The rock is firmly held against mounting plate 1 while slid against fixed bars 2, 4 the finger assembly is then slid against the rock or gem. Nut 16 is tightened securely to position the angle bracket 11. Clamping screw 10 is next tightened until the rock is securely held in place for cutting. Then, when the rock is firmly held by finger 5, bolt 6 is tightened firmly to hold the whole assembly down tight to plate 1 during the rock-cutting process. The heavy-walled pipe section 14 is welded to the underside of mounting plate 1 perpendicular to the plane of plate 1. The pipe section has a plate 15 welded across the end of it to stiffen the pipe section for better gripping in the saw vise. Thus, the pipe section enables the user to secure the rock holder's mounting plate 1 so that its plane is parallel to that of the diamond saw blade.

What is claimed is:

1. A rock-holding device comprising:

a mounting plate having a longitudinal axis and having a flat surface portion for contacting a rock;

a pair of bars mounted on said mounting plate, said bars being mounted at one angle to each other;

a fixably mountable finger slidably adjustable in a line approximately parallel to said longitudinal axis;

a pair of planar surfaces, one on each of said bars, said surfaces extending from said flat surface portion of the mounting plate at an inclined angle towards said finger, for contacting and holding said rock against said finger and said flat working surface; and a bevelled surface on said finger, said bevelled surface extending from said flat surface portion of the mounting plate at an upward angle inclined towards said pair of bars, for contacting and holding said rock against said pair of bars and said flat working surface.

2. The device of claim 1 further comprising:

a longitudinal slot in said mounting plate;

a bolt extending from said finger through said slot, said bolt having a shaft of a diameter less then the width of the slot and a head wider than the width of the slot, for fixing said finger in a slidably adjustable fixed position.

3. The device of claim 2 further comprising a longitudinally adjustable clamping screw for forcing said finger against said rock.

4. The device of claim 3 wherein said finger comprises an upwardly extending rearward portion.

5. The device of claim 2 further comprising a guide pin in said finger extending through said slot and having a diameter approximating the width of the slot.

6. The device of claim 3 wherein said clamping screw had a pointed end which is received in a conical depression in said rearward portion of said finger.

7. The device of claim 4 wherein said clamping screw is threaded through a fixable angle bracket slidably adjustable in said slot.

8. The device of claim 7 wherein said slot extends along a substantial portion of said mounting plate.

* * * * *